United States Patent [19]

Saito et al.

[11] 4,345,186

[45] Aug. 17, 1982

[54] METAL VAPOR DISCHARGE LAMP

[75] Inventors: Masato Saito; Michihiro Tsuchihashi; Yoshinori Takai; Keiji Fukuyama; Keiji Watanabe, all of Kamakura, Japan

[73] Assignee: Mitsubishi Denki Kabushiki Kaisha, Tokyo, Japan

[21] Appl. No.: 130,238

[22] Filed: Mar. 14, 1980

[30] Foreign Application Priority Data

Mar. 28, 1979 [JP] Japan ..... 54-36552
Mar. 30, 1979 [JP] Japan ..... 54-37880
Mar. 30, 1979 [JP] Japan ..... 54-37881

[51] Int. Cl.[3] ..... H01J 7/44; H01J 17/34; H01J 17/78; H01J 29/96

[52] U.S. Cl. ..... 315/49; 315/46; 315/75; 315/100; 315/100; 315/104

[58] Field of Search ..... 315/46, 47, 49, 73, 315/74, 75, 104, 264, 100, 330, 331, 332

[56] References Cited

U.S. PATENT DOCUMENTS 2,329,626 9/1943 Krefft et al. ..... 315/49 X
2,464,704 3/1949 Martin et al. ..... 315/104 X
2,497,542 2/1950 Frech ..... 315/105 X
2,748,315 5/1956 Martin et al. ..... 315/104 X
3,746,914 7/1973 Olson et al. ..... 315/47
4,258,288 3/1981 Michael et al. ..... 315/264

FOREIGN PATENT DOCUMENTS 1467050 12/1966 France ..... 315/73

*Primary Examiner*—Saxfield Chatmon, Jr.
*Attorney, Agent, or Firm*—Oblon, Fisher, Spivak, McClelland & Maier

[57] ABSTRACT

A metal vapor discharge lamp comprises main electrodes and an auxiliary electrode in an arc tube to initiate the discharge between the main electrode and the auxiliary electrode at the initiation of the operation and then to result the discharge between the main electrodes by disconnection of the auxiliary electrode by a bimetallic switch means. A second bimetallic switch means which delays the operation from that of the first bimetal, is connected in series to the first bimetallic switch means so as to discharge in a circuit formed in an outer bulb to break a part of the circuit and to prevent a ballast from overheating.

14 Claims, 7 Drawing Figures

METAL VAPOR DISCHARGE LAMP

BACKGROUND OF THE INVENTION

1. Field of the Invention

The present invention relates to metal vapor discharge lamps such as a high pressure mercury vapor discharge lamp in which mercury and a rare gas are filled; a high pressure sodium vapor discharge lamp in which mercury, a rare gas and sodium are filled; and a metal halide vapor discharge lamp in which mercury, a rare gas and a metal halide are filled. More particularly, it relates to metal vapor discharge lamps which is started by an operation of a heat sensitive switch means such as a bimetallic switch and has an advantage for preventing a ballast from overheating in a fused bond of contacts of the bimetallic switch.

2. Description of the Prior Arts

A metal halide lamp will be described as one embodiment.

The metal halide lamp contains mercury, a rare gas and a metal halide as a discharge sustaining fill and has superior efficiency and color rendering property to those of a high pressure mercury vapor discharge lamp.

FIG. 1 shows a structure of a metal halide discharge lamp which can be operated on a conventional ballast for a high pressure mercury vapor lamp.

An outer bulb made of a light transmissable hard glass (1) covers an arc tube (2) made of a transparent quartz glass in which a rare gas such as neon-argon or neon-krypton and a desired quantity of mercury and a metal halide are filled. Main electrodes (3*a*), (3*b*) are placed at both ends of the arc tube (2) to face each other and are connected through metal foils (4*a*), (4*b*) made of molybdenum to leads (5*a*), (5*b*). The lead (5*a*) is connected through a filament (7) for operating a bimetal (6) as a heat sensitive switch means to a stem lead (8*a*). The other lead (5*b*) is connected through a current feeding wire (9) made of tungsten etc. to the stem lead (8*b*).

An auxiliary electrode (10) is placed to face the adjacent main electrode (3*a*) and is connected through a metal foil (11) to a lead (12).

The lead (12) is connected to a fixed contact (14) placed on a glass bead (13) for holding the bimetal (6) and is further connected through a movable contact (15) placed at one end of the bimetal (6) and the bimetal (6) and a fixed terminal (16) to the stem lead (8*b*). An outer coating (17) for increasing the densities of the metal halides filled in the arc tube (2) at the operation is placed at the end of the arc tube (2).

A Zr-Al type getter is placed in the outer bulb (1) and a Ne-$N_2$ mixed gas having a desired pressure is filled for preventing Ne gas from permeating through the arc tube (2). A stem (19) and a base (20) are equipped.

When the metal halide discharge lamp having said structure is operated by connecting a power source through a ballast for a high pressure mercury vapor discharge lamp, an auxiliary discharge is initiated between the main electrode (3*a*) and the auxiliary electrode (10) and then, the bimetallic switch (6) is operated by the heat generated from the arc tube and the filament (7) after the continuation of the auxiliary discharge for a predetermined time whereby the connection between the fixed contact (14) and the movable contact (15) is disconnected. As in the arc tube (2), the ionized gas is formed by the auxiliary discharge, the main discharge is initiated easily when a surge voltage induced by the ballast is applied between the main electrodes (3*a*), (3*b*).

But, the phenomenon for the discharge between the fixed contact (14) and the movable contact (15) and between the fixed contact and the bimetal (6) is found. Especially, after prolonged operation of the lamp, if the main discharge between the main electrodes (3*a*), (3*b*) is not stabilized after the disconnection of the bimetallic switch, the discharge between both of the contacts (14), (15) is repeated and the contacts are finally fuse-bonded to prevent the normal discharge between the main electrodes whereby a large current substantially equal to a short-circuit current of the ballast continuously flows between the main electrode (3*a*) and the auxiliary electrode (10) disadvantageously to cause overheating the ballast.

SUMMARY OF THE INVENTION

The present invention is to overcome these disadvantages and is to provide a metal vapor discharge lamp which comprises an arc tube and a heat sensitive switch means in an outer bulb to initiate the discharge by a heat sensitive switch means wherein said heat sensitive switch means comprise the first group of one or more heat sensitive switch means and the second group of one or more of heat sensitive switch means which is connected in series to the first group of heat sensitive switch means and is operated in delay to the first group of heat sensitive switch means whereby when a heat sensitive switch means of the second group is operated in the condition of nonoperation of the first group of heat sensitive switch means, a discharge takes place between parts having different potentials in the outer bulb to disconnect a part of the circuit formed in the outer bulb so as to prevent overheating of the ballast.

In the metal vapor discharge lamp having said structure, at least one of the parts having different potentials has easily dischargeable configuration so as to prevent easily overheating of the ballast.

In the metal vapor discharge lamp having said structure, a low melting metal is connected at the discharge part or near the discharge part so as to prevent easily overheating of the ballast.

DETAILED DESCRIPTION OF THE PREFERRED EMBODIMENTS

Figure 1:
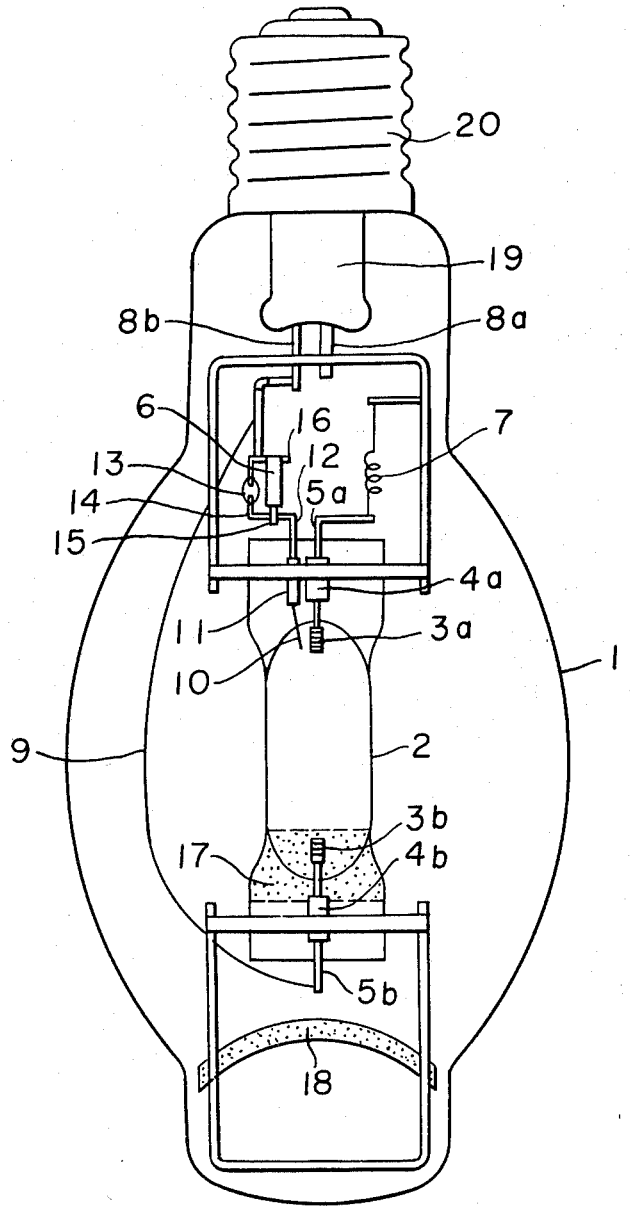
FIG. 1 is a front view of the conventional metal vapor discharge lamp.

Referring to the drawings, the embodiments of the present invention will be illustrated.

Figure 2:
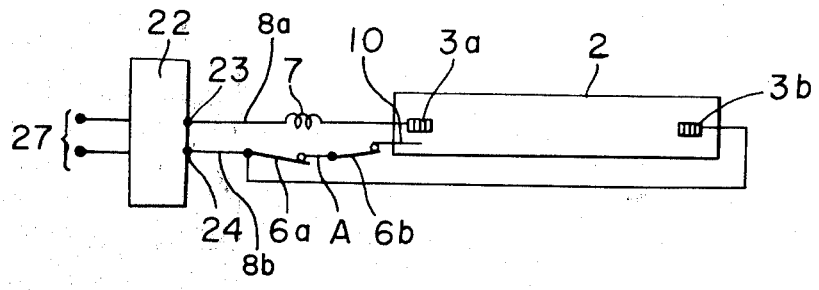
FIGS. 2, 3 and 4 are respectively circuit diagrams of embodiments of the metal vapor discharge lamp of the present invention.

FIG. 2 is a circuit diagram of the metal vapor discharge lamp of the present invention. A pair of the main electrodes (3*a*), (3*b*) are sealed at each end of the arc tube (2) and the auxiliary electrode (10) is placed to face at least one of the adjacent main electrodes (3*a*). The main electrode (3*a*) is connected through a heater (7) for heat sensitive switch means to the secondary terminal (23) of the ballast (22). The auxiliary electrode (10) is connected through the second heat sensitive switch means (6*b*) and the first heat sensitive switch means (6*a*) to the secondary terminal (24) of the ballast (22) and the main electrode (3*b*) is connected to the secondary terminal (24) without connecting to the heat sensitive switch means (6*b*), (6*a*). The second heat sensitive switch means (6*b*) is set to operate in delay to the operation of the first heat sensitive switch means (6*b*). When a power source is supplied through the ballast (22) in such a circuit as shown in said circuit diagram, the auxiliary discharge is started between the main electrode (3*a*) and the auxiliary electrode (10) and then, the first heat sensitive switch means (6*a*) is operated after a predetermined time, to open the connection between the circuit of secondary terminal (23) of ballast (22)-heat (7)-main electrode (3*a*)-auxiliary electrode (10)-second heat sensitive switch means (6*b*) and the circuit of first heat sensitive switch means (6*a*)-secondary terminal of ballast (22) to initiate the main discharge between the main electrodes (3*a*), (3*b*). Thereafter, the second heat sensitive switch means (6*b*) is operated to open the connection between the second heat sensitive switch means (6*b*) and the auxiliary electrode (10). The connection of the second heat sensitive switch means (6*b*)-the second terminal (24) is opened by the operation of the first heat sensitive switch means (6*a*) whereby the operation of the second heat sensitive switch means has no electrical effects under normal circumstances. When a power source is supplied through the ballast (22) under the condition of fused bond of the first heat sensitive switch means (6*a*), a discharge takes place between the part of the joint (A) which connects the first heat sensitive switch means (6*a*) with the second heat sensitive switch means (6*b*) and the part of the main electrode (3*a*)-the secondary terminal (23) of the ballast after the operation of the second heat sensitive switch means (6*b*) since the connection of the first heat sensitive switch means (6*a*) with the second heat sensitive switch means (6*b*) is not opened because of fused bond of the first heat sensitive switch means (6*a*) even after the predetermined time for the discharge between the auxiliary electrode (10) and the adjacent main electrode (3*a*). The discharge results in the disconnection for at least one part of the parts having different potentials to prevent the large current-flow whereby the overheating of the ballast (22) can be prevented. The disconnection can be realized in the discharge part or near the discharge part.

Figure 3:
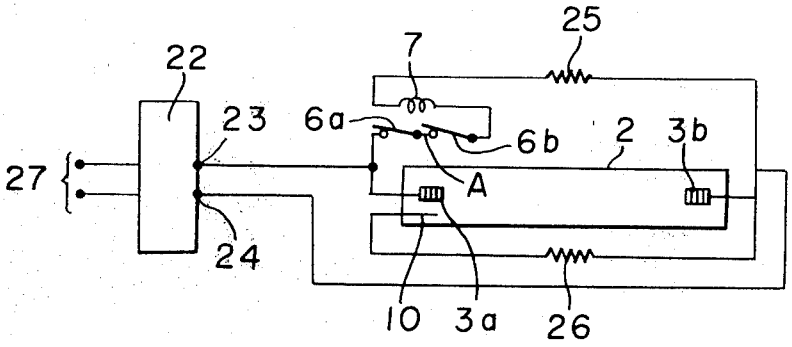

FIG. 3 is the other circuit diagram of the metal vapor discharge lamp of the present invention.

When the power source is supplied through the ballast (22) under normal condition, a closed circuit of secondary terminal (23) of ballast-first heat sensitive switch means (6*a*)-second heat sensitive switch means (6*b*)-heater (7)-current limiting resistor (25)-secondary terminal (24) of ballast is formed. In the closed circuit, a current depending mainly upon a resistance of the current limiting resistor (25) is flown. When the first heat sensitive switch means open after a predetermined time, the surge voltage induced by the ballast is applied between the main electrodes (3*a*), (3*b*) and the glow discharge is struck between the auxiliary electrode (10) connected to the resistor (26) and the main electrode (3*a*) whereby the main discharge between the main electrodes (3*a*), (3*b*) can be easily initiated. When the first heat sensitive switch means come into fused contact under the condition of the small resistance of the current limiting resistor (25) or shortcircuit of the current limiting resistor (25), the overheating of the ballast can not be prevented in the conventional metal vapor discharge lamp without the second heat sensitive switch means.

But, in accordance with the metal vapor discharge lamp of the present invention, the discharge is struck between the joint (A), which connects the first heat sensitive switch means (6*a*) and the second heat sensitive switch means (6*b*), and a part of the circuit connected to the secondary terminal (24) of the ballast whereby at least one of the part of the closed circuit is disconnected to prevent the overheating of the ballast.

Figure 4:
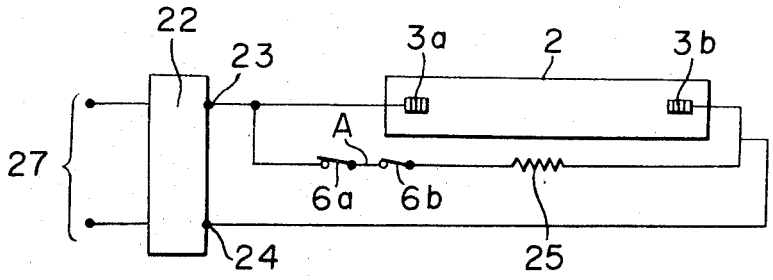

FIG. 4 is the other circuit diagram of the metal vapor discharge lamp of the present invention. When the power source is supplied through the ballast (22) under the normal circumstances, a closed circuit of secondary terminal (23) of ballast-first heat sensitive switch means (6*a*)-second heat sensitive switch means (6*b*)-current limitting resistor (25)-secondary terminal (24) of ballast is formed. In the closed circuit, a current flows corresponding to the resistance of the current limiting resistor (25) and the inductance of the ballast (22) and a surge voltage is applied between the main electrodes (3*a*), (3*b*) by the operation of the first heat sensitive means (6*a*) after a predetermined period, to operate the main discharge between the main electrodes (3*a*), (3*b*). When the first heat sensitive switch means come into fused-contact under the condition of the small resistance of the current limitting resistor (25) or shortcircuit of the current limiting resistor (25), the overheating of the ballast can not be prevented in the conventional metal vapor discharge lamp without the second heat sensitive switch means.

But, in accordance with the metal vapor discharge lamp of the present invention, the discharge is struck between the joint (A), which connects the first heat sensitive switch means (6*a*) and the second heat sensitive switch means (6*b*), and a part of the circuit connected to the secondary terminal (24) of the ballast whereby at least one of the part of the closed circuit is disconnected to prevent the overheating of the ballast.

The embodiment of the metal vapor discharge lamp of the present invention will be illustrated.

Figure 5:
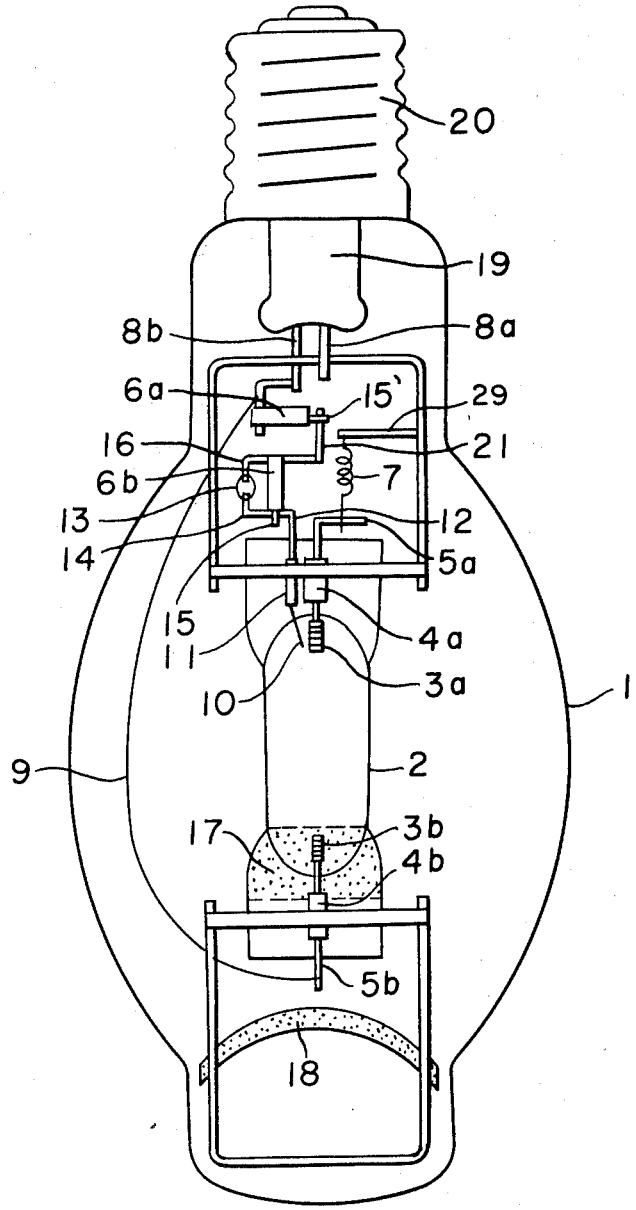
FIG. 5 is a front view of one embodiment of the metal vapor discharge lamp of the present invention.

FIG. 5 shows one embodiment of the metal halide discharge lamp of the present invention. The lead (12) connected through the metal foil (11) to the auxiliary electrode (10) is welded on a fixed joint rod (14) connected to the glass bead (13). The movable contact (15) formed at one end of the bimetal (6*b*) as the heat sensitive switch means is brought into contact with the fixed joint rod (14). The other end of the bimetal (6*b*) is welded on the other fixed joint rod (16) connected to the glass bead (13). The fixed joint rod (16) is in series through the lead (21) with the movable contact (15') placed at one end of the bimetal (6*a*) as heat sensitive switch means, and is connected to the stem lead (8*b*).

The lead (21) is placed with a short gap to the filament (7) or the filament fixed rod (29). The bimetal (6*b*) as the second heat sensitive switch means is set so as to open the movable contact (15) from the fixed joint rod (14) after a period longer than the period for opening the bimetal (6*a*) as the first heat sensitive switch means. The other structure is substantially the same as that of the conventional metal halide discharge lamp.

In the metal halide discharge lamp having said structure, when the power source is supplied through the ballast for the high pressure mercury vapor discharge lamp under the normal circumstances, the auxiliary dicharge is struck between the main electrode (3*a*) and the auxiliary electrode (10). After the continuation of the auxiliary discharge for a specific time, the bimetal (6a) as the first heat sensitive switch means is operated to disconnect the connection between the lead (21) and the movable contact (15') whereby the main discharge is struck between the main electrodes (3a), (3b). The contact of the movable contact (15) of the bimetal (6b) as the second heat sensitive switch means with the fixed joint rod (14) is disconnected after forming the main discharge. When the movable contact (15') of the bimetal (6a) as the first heat sensitive switch means come into a fused bond with the lead (21), and the contact of the movable contact (15) with the fixed joint stem (14) is disconnected, a discharge is struck between parts having different potential such as between the lead (21) and the filament (7) or between the lead (21) and the filament fixed rod (29) whereby the lead (21), the filament (7), the bimetal (6b) as the second heat sensitive switch means or the filament fixed rod (29) or (5a) is cut caused by a fusion and the current is cut off to prevent the overheating of the ballast.

In the metal vapor discharge lamp shown in FIG. 5, the first heat sensitive switch means (6a) should be connected through the second heat sensitive switch means (6b) to the auxiliary electrode (10) through at least the second heat sensitive switch means (6b). The two kinds of the auxiliary heat sensitive switch means can be respectively each one, but higher reliability is attained by using two or more means for each of the first and second heat sensitive switch means.

The prolonged life of the metal vapor discharge lamp can be maintained by forming the first heat sensitive switch means. When the operations times of the plurality of the first heat sensitive switch means are set slightly shifted, even though the discharge is repeated between the contacts of one of the plurality of the first heat sensitive switch means under the condition of preventing the main discharge between the main electrode (3a), (3b) by an increase of the operation voltage of the arc tube or a deterioration of the heat sensitive switch means in its life, the main discharge can be struck without failure by the operation of the other heat sensitive switch means. It is preferable to set a gap in a range of 0.5 to 50 mm between the parts having different potentials for the discharge. When it is less than 0.5 mm, the parts having different potentials may come into a fused bond by the discharge whereas when it is more than 50 mm, it is difficult to form the discharge between the predetermined parts.

When the gas filled in the outer bulb is at least one of the gas selected from the group consisting of He, Ne, Ar, Kr, Xe and $N_2$, there is the effect for resulting in the discharge without failure and also for preventing a deterioration of substrates of in the outer bulb. The gas is preferably filled in the outer bulb under a pressure of less than 2 atm. When it is higher than 2 atm., it is difficult to form the discharge between the predetermined parts.

When the gas is not filled in the outer bulb to maintain a vacuum degree to less than $10^{-1}$ Torr, the effect of the invention can be imparted.

The effect of the present invention can be imparted in the other discharge lamp for initiating the discharge by the operation of the heat sensitive switch means even though the circuit diagram is different from those of the embodiments shown in the drawings.

Figure 6:
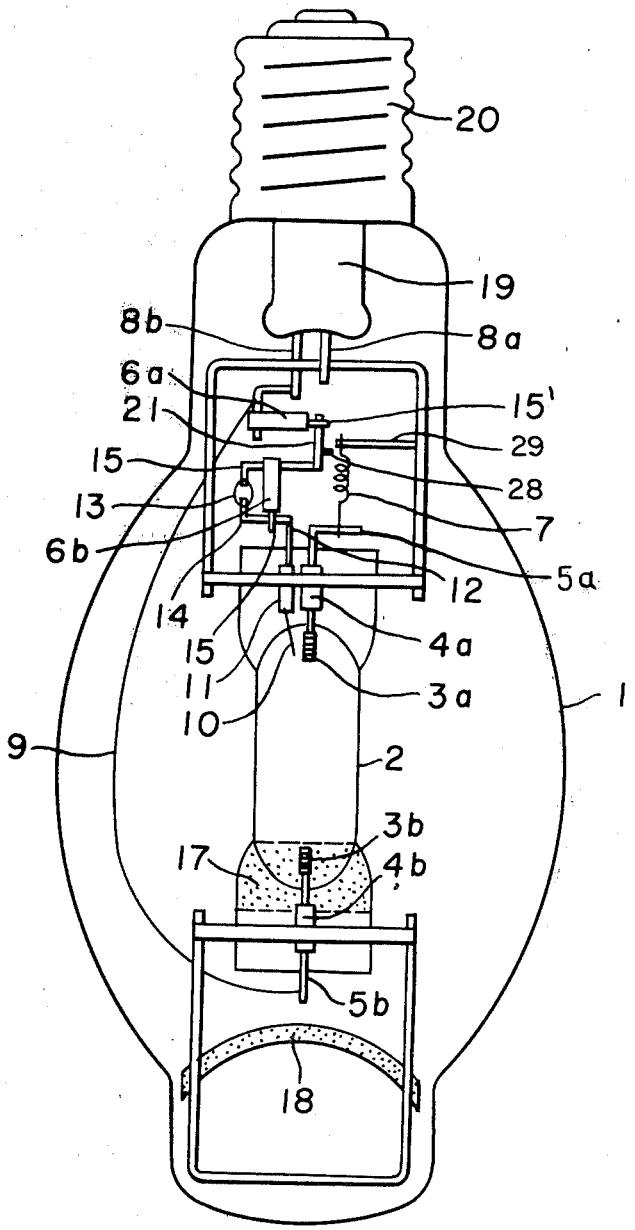
FIGS. 6 and 7 respectively designate front views of the other embodiments of the metal vapor discharge lamp of the present invention.

FIG. 6 shows the other embodiment of the metal halide discharge lamp of the present invention.

The projected lead (28) is formed on the lead (21). The safety lead (28) is placed with a quite short gap to the filament (7) or the filament fixed rod (29). The bimetal (6b) as the second heat sensitive switch means is set so as to disconnect the movable contact (15) from the fixed joint rod (14) after a period longer than that of the bimetal (6a) of the first heat sensitive switch means. The other structure is substantially the same as that of the metal halide discharge lamp shown in FIG. 5.

In accordance with the metal halide discharge lamp having said structure, the safety lead (28) is formed on the lead (21) whereby the distance of the safety lead to the part having different potential such as the filament (7), the filament fixed rod (29) or (5a) can be set to a predetermined distance. Thus, the discharge can be securely formed to prevent the overheating of the ballast.

At least one of the parts having different potentials preferably has such a configuration for easy discharge as a needle, plate, foil or coil, whether the safety lead (28) is utilized or not. When it has such configuration, the discharge is easily formed between the parts having different potentials when the second heat sensitive switch means is operated under the condition of the fused bond of the first heat sensitive switch means. Moreover, the fused break of the easily dischargeable configuration parts can be easily resulted by the heat generated by the discharge is speedy.

Figure 7:
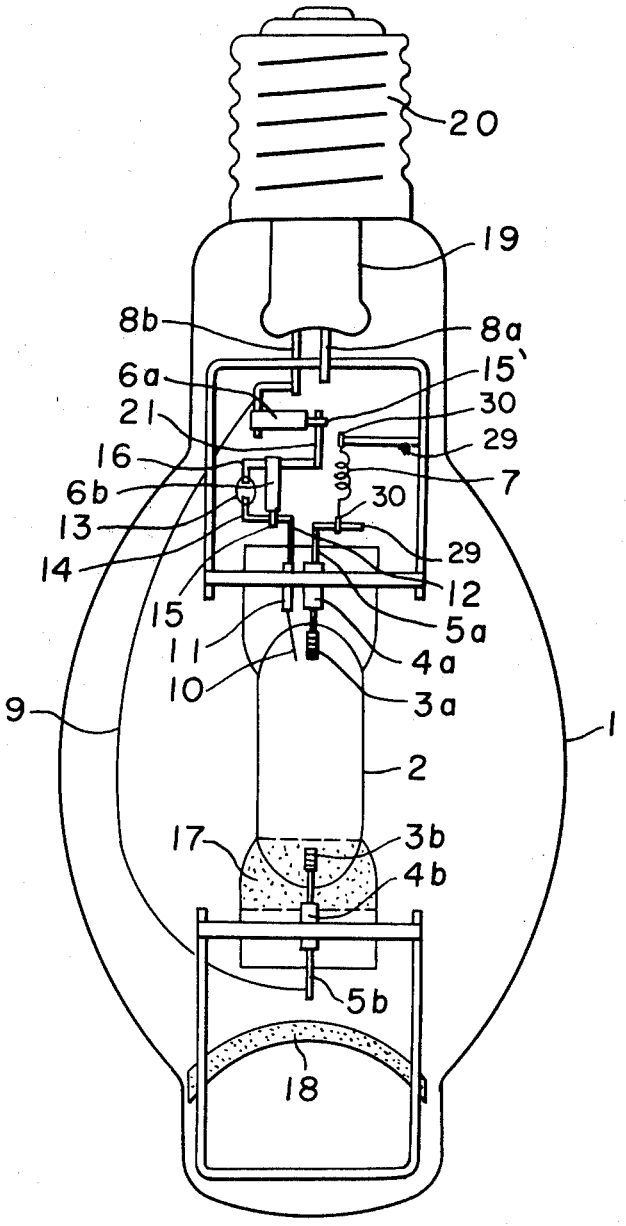

FIG. 7 shows the other embodiment of the metal halide discharge lamp of the present invention. Nickel sleeves (30) made of a low melting metal are formed at both ends of the filament (7) and the lead (21) and the filament (7) or the filament fixed rod (29) are placed with a quite short gap and the bimetal (6b) as the second heat sensitive switch means is set so as to open the movable contact (15) from the fixed joint rod (14) after a period longer than that of the bimetal (6a) as the first heat sensitive switch means. The other structure is substantially the same as that of the metal halide discharge lamp shown in FIG. 5.

In accordance with the metal halide discharge lamp having said structure, the nickel sleeves (30) made of lower melting metal are formed at both ends of the filament (7) whereby the fused break of the nickel sleeve (30) is resulted by the heat generated by the discharge and the current to the main electrode (3a) is stopped to prevent the burning of the ballast.

The filament (7) can be connected through the nickel sleeve (30) to the filament fixed rod (29) or can be also connected directly to the fixed rod (29) by welding the nickel sleeve (24) on the filament (7). In the latter case, the fused break of the filament (7) or the fixed stem (29) is resulted by the heat generated by the melting of the nickel sleeve. The same effect can be expected by using a metal having a melting point of 400° to 2500° C. instead of the nickel sleeve (24). When it has a melting point of lower than 400° C., the disconnection may happen during the operation of the lamp to give a short life whereas when it has a melting point of higher than 2500° C., the said effect is not satisfactory.

When a part or whole of the lead (21) is made of a low melting metal such as nickel, the fused break of the circuit can be resulted by the discharge without failure.

We claim:

1. A metal vapor discharge lamp comprising:

an outer bulb;

an arc tube disposed in said bulb;

first heat sensitive switch means disposed in said bulb for initiating a discharge in said arc tube, including at least one heat sensitive switch;

second heat sensitive switch means disposed in said bulb in series with said at least one heat sensitive switch, said second heat sensitive switch means having a heat sensitive switching characteristic delayed with respect to that of said first heat sensitive switch means; and means for producing a discharge within said outer bulb and outside of said arc tube in the event of fused bonding of said first heat sensitive switch means and subsequent opening of said second heat sensitive switch means, including discharging parts at different potentials defining a discharge gap by a discharge caused by a surge voltage generated after opening of said second heat sensitive switch means.

2. A metal vapor discharge lamp according to claim 1 wherein said gap between said parts having different potentials for producing the discharge in said outer bulb is in a range of 0.5 to 50 mm.

3. A metal vapor discharge lamp according to claim 1 or 2 wherein a gas pressure in said outer tube is lower than 2 atm.

4. A metal vapor discharge lamp according to claim 1 wherein at least one of gas selected from the group consisting of He, Ne, Ar, Kr, Xe and $N_2$ is filled in said outer bulb.

5. A metal vapor discharge lamp according to claims 1 or 2 wherein at least one of said first and second heat sensitive switch means is formed by a plurality of heat sensitive switches.

6. A metal vapor discharge lamp according to claim 1 wherein said parts having different potentials have an easily dischargeable configuration.

7. A metal vapor discharge lamp according to claim 6 wherein at least one of said parts having different potentials has a configuration selected from the group consisting of projection, needle, plate, foil, ribbon and coil configurations.

8. A metal vapor discharge lamp according to claim 6 wherein at least one of said parts having different potentials in said outer bulb has a projection configuration projected toward the other part.

9. A metal vapor discharge lamp according to claim 1 wherein a low melting metal is connected at said discharge parts or near said discharge parts.

10. A metal vapor discharge lamp according to claim 9 wherein said low melting metal is a material having a melting point of 400° to 2500° C.

11. A metal vapor discharge lamp according to claim 11, further comprising:

means for heating said first and second heat sensitive switch means when said first and second heat sensitive switch means are conducting current.

12. A metal vapor discharge lamp according to claim 11, wherein said heating means comprises:

a heating filament thermally coupled to said first and second heat sensitive switch means.

13. A metal vapor discharge lamp according to claim 12, wherein said filament is connected in series with said arc tube.

14. A metal vapor discharge lamp according to claim 12, wherein said filament is connected in series with said first and second heat sensitive switches, the series combination of which is connected in parallel with said arc tube.

* * * * *